US005192397A

United States Patent [19]

Bohman

[11] Patent Number: 5,192,397

[45] Date of Patent: Mar. 9, 1993

[54] METHOD AND APPARATUS FOR CLEANING OF A PULP SUSPENSION

[75] Inventor: Ake Bohman, Johanneshov, Sweden

[73] Assignee: Milan Kolman, Sweden

[21] Appl. No.: 761,767

[22] PCT Filed: Feb. 13, 1990

[86] PCT No.: PCT/SE90/00095

§ 371 Date: Aug. 13, 1991

§ 102(e) Date: Aug. 13, 1991

[87] PCT Pub. No.: WO90/09242

PCT Pub. Date: Aug. 23, 1990

[30] Foreign Application Priority Data

Feb. 13, 1989 [SE] Sweden ..... 8900472

[51] Int. Cl.[5] ..... B04C 5/14; B04C 9/00; D21D 5/24

[52] U.S. Cl. ..... 162/55; 162/4; 209/211; 210/197; 210/512.1; 210/787

[58] Field of Search ..... 162/4, 55; 209/211; 210/197, 512.1, 512.2, 787

[56] References Cited

U.S. PATENT DOCUMENTS 3,259,246 7/1966 Stavenger ..... 210/197
3,529,724 9/1970 Maciola et al. ..... 210/197

*Primary Examiner*—Karen M. Hastings

[57] ABSTRACT

The present invention relates to a method and an arrangement in a fibre reclaimer for cleaning of heavy and light contaminate particles from a fibre suspension and said fibre reclaimer comprises at least a vessel (4) having an opening (15) which via a connection arrangement (1, 2) is connectable to a cyclone. The connection arrangement consists of a cone (1) having an outlet (13) with a predetermined diameter (d) and is inserted and located in a conical mantle (2), which with its free end part (14) is fixed to the opening (15) of the vessel (4), whereby the opening (13) is situated a predetermined distance (A) from the opening (15). The vessel (4) has a suction pipe (3), which with its opening (16) having a predetermined diameter (D), is concentrically situated in the opening (15) for forming a ring shaped opening gap (17) between the pipe (3) and the vessel (4) and which pipe (3) extends downwardly in the vessel (4) or adjacent vessles to terminate with its other tail end (18) a predetermined distance from the bottom of the vessel, said distance is depending on if light or heavy contaminate particles shall be separated from the fibre suspension. The method for cleaning of a pulp suspension concerns to achieve a vacuum in the lower part of the cone (1) to resuck pulp suspension from the vessel (4) through the pipe (3), cone (1) and into the cyclone.

3 Claims, 2 Drawing Sheets

METHOD AND APPARATUS FOR CLEANING OF A PULP SUSPENSION

The present invention relates to a method and an apparatus for cleaning of a pulp suspension from heavy as well as light contaminate particles, and the cleaned suspension is accepted without any fiber losses.

The object of the present invention is to provide a method and an apparatus by which is maintained a high cleaning efficiency of a pulp suspension with respect of both heavy and light contaminate particles. The distinguishing features characterizing the invention are described herein.

BRIEF DESCRIPTION OF THE DRAWINGS

The invention will now be described in detail with reference to the accompanying drawings, in which FIG. 1 schematically illustrates in a side view and partly in a cross section a preferred embodiment of a fiber reclaimer according to the present invention and with respect to a separation of heavy contaminate particles, FIG. 2 schematically illustrates in a side view and partly in a cross section an embodiment of a fiber reclaimer according to the present invention and with respect to a separation of light contaminate particles such as polymer and adhesive substances (stickies).

DETAILED DESCRIPTION

Figure 1:
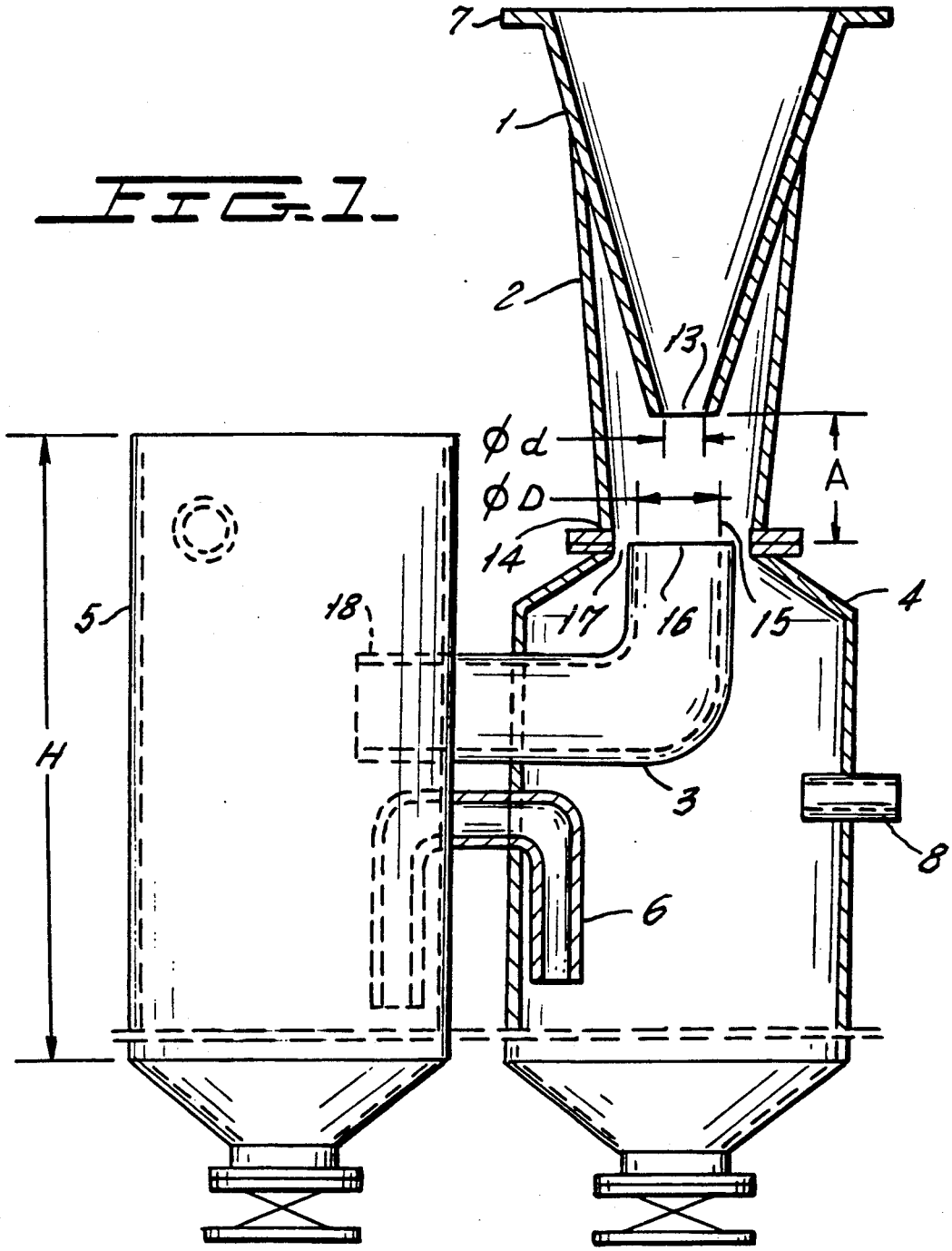

Referring to FIG. 1 the fiber reclaimer according to the present invention consists of a connection arrangement including a cone 1 which is terminating in a conical housing 2, a suction pipe 3, vessels 4,5 and at least one connection pipe 6 if there are at least two vessels 4,5. A cyclone not illustrated in the drawings is with its lower cone and flange connected to the cone 1 with its flange 7.

A fibre or pulp suspension which is to be cleaned is injected tangentially through an inlet of the cyclone with a determined pressure. In the cyclone the suspension is divided into accept (cleaner suspension) and into reject (suspension uncleaned with heavy and even light contaminate particles). With known technics of today it is almost impossible to recycle and save all fibres from cleaning operations and therefore some fibres get into the sea. According to the present invention all fibres are to the contrary recycled and saved e.g. in the last stage of a cleaner installation.

The cleaning or separation according to the method of the present invention is achieved by pressing the reject through the cone 1 and against and through its outlet 13 having a diameter d. After that the reject is expanding in the conical housing 2 and flows into the vessel 4 through an opening gap 17 between the vessel 4 and the suction pipe 3. In the vessels 4,5, the height H of which determines the time of delay in the fiber reclaimer, the heavy contaminate particles are separated (e.g. sand from the suspension). The pulp suspension is filling up the vessel 5 through the connecting pipe 6 and get in this way a further opportunity to be free from fine sand. Heavy contaminate particles are sinking to the bottom of the vessels and where they can be emptied manually or automatically.

When the suspension flows into the vessel 4 through th opening gap 17 a vacuum zone is created between the diameter d of the cone 1 and an opening end 16 having a diameter D resulting in that all suspension which reaches the level of a second tail end 18 of the suction pipe 3, will be resucked through the cone 1 into the cyclone. The importance of the diameter of the cone 1 of the outlet 13 and of the diameter D of the suction pipe 3 of the opening end 16 is as follows. For cyclones or cleaners with low capacity e.g. 100 l/min it is characteristic that the outlet diameter d of the cone 1 is small (e.g. some mm). The opening end or mouth 16 of the suction pipe 3 may not be of the same order of magnitude or size because the suction pipe 3 is more susceptible to be plugged up with fibres than the outlet 13 of the cone 1 having the diameter d.

The diameter D of the suction pipe 3 of the opening end 16 must be much greater than the diameter d when d is small. Only when the diameter d of the cone 1 reaches about 30–40 mm the diameter D also can reach to 40 mm. When using large dimensions of d, the diameter D can be smaller than the diameter d and the distance A in FIG. 1 can be reduced to zero. The geometry around the cone 1 and the suction pipe 3, the distance A between the outlet 13 of the cone 1 having the diameter d and the opening end 16 of the suction pipe 3 having the diameter D, the time of delay of the suspension in the vessels (depending on the height H) and the number of vessels, all these are affecting or determining the cleaning efficiency of the fiber reclaimer.

Fiber reclaimers also can include only one vessel 4 with suction pipe 3 or also include a plurality of vessels connected to each other by connecting pipes 6. On the vessel 4 there is a valve 8 for waterfeed if delution is required. The cleaning efficiency is increased when the fiber consistency is decreased.

Figure 2:
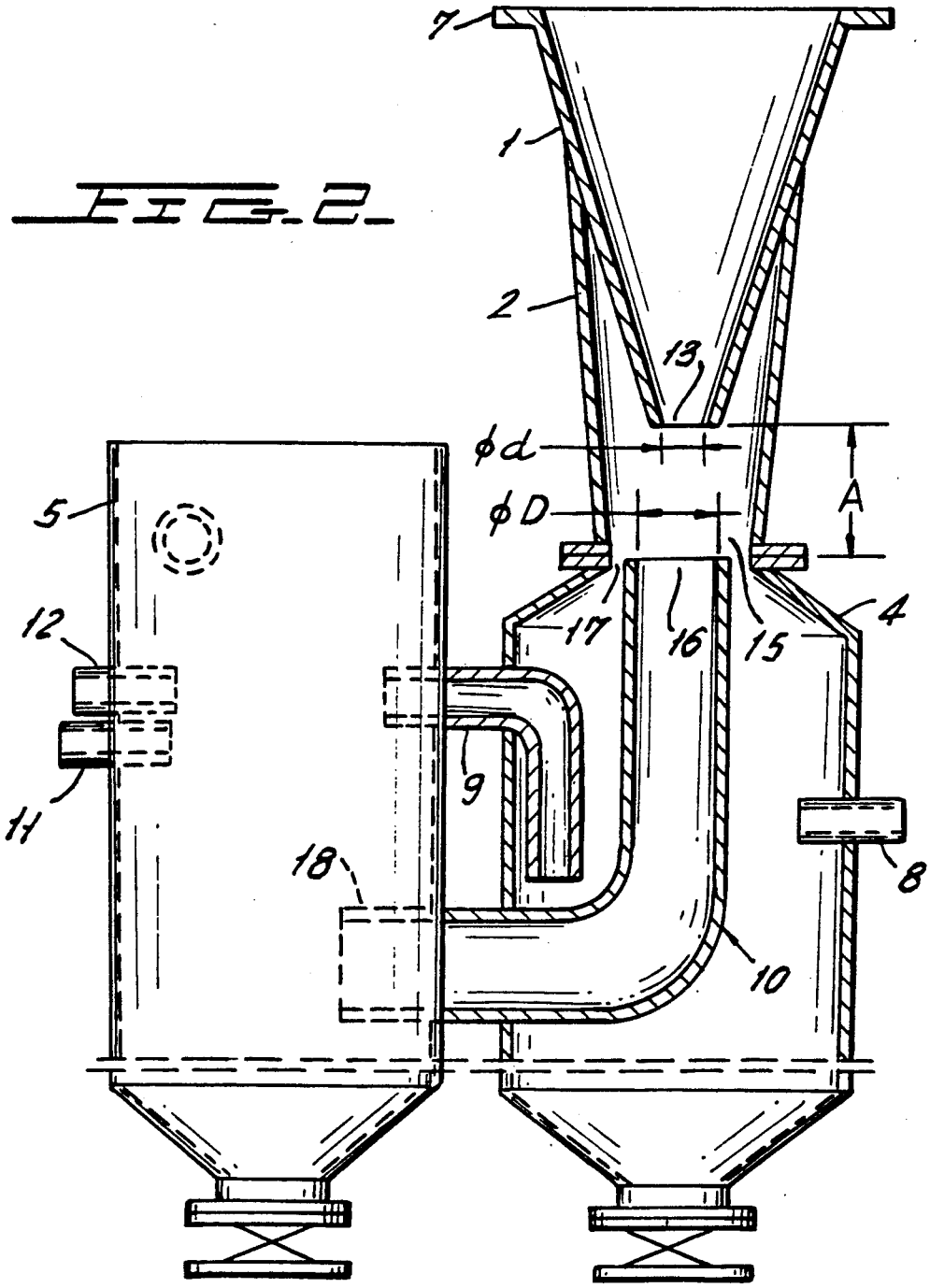

The separation of light contaminant particles, e.g. adhesive substances (stickies), which can be present in some pulp suspensions, could be achieved by means of an arrangement illustrated in FIG. 2. These stickies occur i.a. in fibres which are recycled from secondary paper and are descended from envelopes (glue), backs of books etc. In order to be able to separate the fibres in the reject fraction from stickies and bring the cleaned fibres back to the accept this is done in the same way as described above, but with a modification. A connection pipe 9 is ended in the upper part of the connected vessel or vessels. This arrangement is done because of the fact that the stickies are gathering (collecting) on the surface in the upper part of the vessels. A suction pipe 10 is provided on a relatively low level near the bottom of the vessel with the aim to suck the pulp suspension free from stickies. Close below the upper part of the connection pipe 9 a valve 11 is placed for discharging suspension having concentrated stickies. Light contaminate particles can be supplied from outside to the connection 12 of the vessel 5 in FIG. 2, e.g. from the cyclone which is separating light contaminate particles but is retaining a lot of good fibres.

I claim:

1. An arrangement in a fiber reclaimer for cleaning of a pulp suspension from heavy and light contaminate particles and comprising at least one vessel (4,5) with an opening (15), which is via a connecting arrangement (1,2) connected to a cyclone or cleaner, wherein said at least one vessel comprises a first vessel with the opening and at least one adjacent vessel.

the connecting arrangement (1,2) consists of a cone (1), converging towards the first vessel (4) and terminates with an outlet (13) having a predetermined diameter (d) and is inserted and located in a conical housing (2), which has a free end part (14)

fixed to the opening (15) of the first vessel (4), whereby the outlet (13) of the cone (1) is situated a predetermined distance (A) from the opening (15) of the first vessel (4);

the first vessel (4) contains a suction pipe (3), one end of which is provided with an opening (16) having a predetermined diameter (D), which is concentrically situated in the opening (15) of the first vessel (4) to form a ring shaped opening gap (17) in the opening (15) between the suction pipe (3) and the first vessel (4) and said suction pipe (3) extends downwardly in the first vessel (4) and changes its direction a predetermined distance from the bottom of said first vessel to continue into said at least one adjacent vessel (5) and having its second end (18) terminating a predetermined distance from the bottom of the adjacent vessel (5); and the first vessel (4) is connected to the adjacent vessel (5) by at least one connection pipe (6,9) for filling of the pulp suspension.

2. An arrangement according to claim 1, characterized in that the diameter (D) of the opening (16) of the suction pipe (3) is larger than the diameter (d) of the outlet (13) of the cone (1).

3. A method for cleaning of heavy and light contaminate particles from a fibre suspension by a fibre reclaimer comprising at least one vessel (4,5) having an opening (15), which is via a connecting arrangement in the form of a cone (1), which is inserted and fixed and terminates in a conical housing (2), connected to a cyclone or cleaner, wherein said at least one vessel comprises a first vessel with the opening and at least one adjacent vessel comprising pressing a reject fraction from the cyclone or cleaner through the cone (1) and downwardly through its outlet (13) to expand in the conical housing (2) and flow the first vesesl (4) through a ring shaped opening gap (17) situated in the opening (15) of the first vessel (4) between a suction pipe (3) emerging in said opening and the first vessel (4), said suction pipe (3) having a tail end extending from said at least one adjacent vessel (5), filling said adjacent vessel with the fibre suspension by a connection pipe which connects said first vessel and said adjacent vessel, creating a vacuum so that all the fibre suspension which is near the tail end (18) of the suction pipe (3) in said adjacent vessel (5) is, due to the vacuum, resucked into the suction pipe (3) and through the cone (1) into the cyclone or cleaner.

* * * * *